US005795692A

United States Patent [19]

Lewis

[11] Patent Number: 5,795,692

[45] Date of Patent: Aug. 18, 1998

[54] CARRIER COMPOSITION AND PROCESSES THEREOF

[75] Inventor: Richard B. Lewis, Williamson, N.Y.

[73] Assignee: Xerox Corporation, Stamford, Conn.

[21] Appl. No.: 829,665

[22] Filed: Mar. 31, 1997

[51] Int. Cl.[6] ..... G03G 9/107; G03G 9/113

[52] U.S. Cl. ..... 430/106.6; 430/108; 430/137

[58] Field of Search ..... 430/106, 108, 430/106.6, 137

[56] References Cited

U.S. PATENT DOCUMENTS

| | | | |
|---|---|---|---|
| 3,839,029 | 10/1974 | Berg et al. | 96/1 SD |
| 4,546,060 | 10/1985 | Miskinis et al. | 430/108 |
| 4,764,445 | 8/1988 | Miskinis et al. | 430/108 |
| 5,534,378 | 7/1996 | Adel et al. | 430/108 |

*Primary Examiner*—John Goodrow
*Attorney, Agent, or Firm*—John L. Haack

[57] ABSTRACT

A carrier composition comprised of a core comprised of a magnetic oxide with a coating thereover comprised of the reaction product of a metal, preferably a zinc vapor and the magnetic oxide.

16 Claims, No Drawings

CARRIER COMPOSITION AND PROCESSES THEREOF

REFERENCE TO COPENDING AND ISSUED PATENTS

Attention is directed to commonly owned and assigned U.S. Pat. No. 5,424,160, issued Jun. 13, 1995, entitled "CONDUCTIVE CARRIER COATINGS AND PROCESSES FOR THE PREPARATION THEREOF."

The disclosures of the above mentioned patent is incorporated herein by reference in its entirety.

BACKGROUND OF THE INVENTION

The present invention is generally directed to xerographic carrier compositions and processes for the preparation and use thereof. More specifically, the present invention relates to carrier and developer compositions wherein ferrite carrier core particles are treated by exposure of the core particles to zinc vapor with the primary result that the treated carrier particles possess reduced electrical resistivity, and conversely, increased electrical conductivity. The treated carrier particles of the present invention, in embodiments, provide improved developability characteristics in, for example, various magnetic developer compositions useful in xerographic developers and development systems.

Ferrite particles are known and are used for xerographic developer carrier cores either with or without a resin overcoating. The ferrite particles are either magnetically soft ferrites, for example, as used in a Xerox Corporation Model 9200 duplicator, or magnetically hard ferrites. The resistivities of these ferrites are on the order of about $10^9$ to $10^{10}$ ohm centimeters. Frequently, xerographic imaging requires that the carrier be more electrically conductive. Although not wanting to be limited by theory, this may be necessary to dissipate carrier bead counter charge or to reduce the dielectric thickness of the developer mass. Conductive carrier coatings such as carbon loaded lacquers or carbon-containing dry powder coated polymers are relatively ineffective on insulating cores because they transport currents around the outside of the cores. On conducting cores these polymer coatings are more effective since they allow currents to access and pass through the cores.

PRIOR ART

In U.S. Pat. No. 4,546,060, issued Oct. 8, 1985, to Miskinis et al., there is disclosed hard ferrite magnetic carrier particles for use in two component developers.

In U.S. Pat. No. 4,764,445, issued Aug. 16, 1988, to Miskinis et al., there is disclosed hard ferrite magnetic carrier particles for use in two component developers together with toner particles for the development of electrostatic latent image patterns and containing from about 1 to about 5 percent by weight of lanthanum incorporated in the ferrite composition in its green stage, before firing. The lanthanum containing carrier is thereby made electrically conductive and, for this reason according to the disclosure of this patent, exhibits development efficiency improved over developers based on electrically insulating carriers.

In U.S. Pat. No. 3,839,029, issued Oct. 1, 1974, to Forgensi et al., there is disclosed an electrostatographic imaging process comprising forming an electrostatic latent image on a surface and developing said image by contacting it with a developer mixture of finely-divided toner particles electrostatically clinging to the surfaces of carrier beads comprising electrically insulating, magnetically soft nickel-zinc ferrite or manganese-zinc ferrite beads characterized as being substantially dense and uniform in size and shape with maximum roundness and sphericity and having substantially uniform electrostatographic properties such as triboelectricity, magnetic permeability, and electrical conductivity, whereby at least a portion of the toner particles are attracted to and deposited on said surface in conformance to said latent image.

Conductive magnetic brush (CMB) development systems are known in the art and provide for efficient, reliable, and cost effective xerographic development means. These systems have been prepared through powder coating by partially coating conductive carrier cores with electropositive or electronegative polymers to provide a balance of control over conductivity and tribo charging characteristics, for example, as disclosed in U.S. Pat. No. 5,015,550, issued May 14, 1991, to Creatura et al. CMB carriers have also been obtained by solution coating of mixtures of polymers and conductive particles, typically carbon black, onto various conductive and insulative carrier cores to yield developers of controlled conductivity, for example, as disclosed in U.S. Pat. No. 5,102,769, issued Apr. 7, 1992 to Creatura. Submicron polymer/carbon black composite particles prepared, for example, by suspension polymerization techniques are also useful in the preparation of CMB carriers by powder coating processes as disclosed in, for example, U.S. Pat. No. 5,236,629, issued Aug. 17, 1993, to Mahabadi et al. The CMB carriers obtained through partial coating with polymers and polymer composites provide a limited range of control over conductivity and tribo values. Suspension polymerized resin carbon black composites have provided effective, conductive electropositive materials, reference the aforementioned U.S. Pat. No. 5,236,629.

The aforementioned references are incorporated in their entirety by reference herein.

There continues to be a need for uncoated and polymer coated ferrite carrier compositions with high conductivity characteristics suitable for use with a variety of toner compositions, particularly color applications, and which provide improved developer compositions with low electrical resistance and high developability properties.

There also remains a need for highly conductive ferrite carrier compositions which are easily and economically prepared, possess high environmental stability, are compatible with a variety of toner compositions, and which carriers can be processed using conventional methodology. There also remains a need for conductive carrier compositions that are suitable for use in high speed magnetic development systems.

SUMMARY OF THE INVENTION

Embodiments of the present invention, include:

- overcoming a number of deficiencies of the prior art conductive carrier compositions by providing metal modified or surface coated ferrite carrier core particles with high conductivity and high environmental stability;
- providing simple and economical processes for the preparation of highly conductive coated ferrite carrier core particles; and
- providing imaging processes for preparing high quality black and white, and color xerographic images using the aforementioned highly conductive metal coated ferrite carrier core particle compositions.

Still other embodiments of the present invention include processes for treating, for example, hard or soft ferrite carrier core particles in a reducing atmosphere in the presence of a metal vapor, such as zinc, wherein the resulting metal modified or coated carrier particles are provided with a reduced electrical resistivity property.

DETAILED DESCRIPTION OF THE INVENTION

The coated carrier composition and processes thereof of the present invention are useful in a variety of two component particulate developer materials. An advantage of the present invention is that the coated carrier composition and processes thereof afford formulation control over the conductivity properties of the resulting developers and thereby enable developers with improved development properties in a variety of two component developer housings configurations and development processes.

Thus, in embodiments, there is provided a carrier composition comprised of core particles comprised of a magnetic oxide with a coating thereover comprised of the reaction product of zinc vapor and the magnetic oxide. In embodiments, depending upon the amount of zinc metal selected relative to the amount of the core particles to be coated, the temperature, and the duration of the coating process, the coating can also comprise a layer of codeposited metallic zinc together with the reaction product of the zinc vapor and the metal oxide surface species.

In embodiments, the metal modified or coated core particles can further comprise coating the carrier composition with at least one polymer to further enhance the development characteristics and properties of the carrier particles. The polymer coated carrier can include, if desired, minor amounts of a conductive additive material contained in the polymer coating. Conductive additive materials include, for example, conductive pigments, such as carbon black, finely divided metallic particles, such as iron, and copper, highly conductive organic polymers, such as, polythiophenes, and polyphenylenes, and the like. The percentage of carbon black is typically from about 10% to about 30% with about 20% being preferred. Other conductive additive percentages would be the same after adjustment for both their density relative to carbon black and for their ability to form connected structures within the surrounding polymer.

The magnetic oxide selected for the core particle can be a hard magnetic ferrite material, for example, strontium ferrite, barium ferrite, lead ferrite, cobalt ferrite, and the like, and mixtures thereof. Alternatively, the magnetic oxide selected can be a soft magnetic ferrite material such as a ferrous ferrite, manganese ferrite, nickel ferrite, copper ferrite, magnesium ferrite, zinc ferrite, and the like, and mixtures thereof. In still other embodiments, the core particles selected can be a mixture of hard magnetic ferrite materials and soft magnetic ferrite materials, in weight ratios of from about 10:90 to about 90:10.

The weight ratio of core particles to zinc metal selected for use in the coating process can be from about 99.5:1 to about 90:10, and preferably the zinc is used in amounts of from about 0.5 to about 10 weight percent relative to the weight of the core particles. The thickness of the resulting conductive coating can be from about 0.01 to about 10 microns, and depends upon the amount of zinc metal selected relative to the core particles, the extent and duration of the deposition process, and the like parameters. The resulting treated carrier core particles are electrically conductive and exhibit a packed bed resistivity of less than from about $10^{-1}$ to about $10^{5}$ ohm-centimeters and preferably less than about $10^{-1}$ to about $10^{3}$ ohm centimeters.

In embodiments of the present invention there are provided, developer compositions comprising a carrier composition comprised of core particles comprised of a magnetic oxide with a coating thereover comprised of the reaction product of zinc vapor and the magnetic oxide, and a toner comprising a pigment and a resin.

In embodiments of the present invention there are provided processes for the preparation of electrically conductive magnetic oxide carrier particles comprising: heating a mixture of magnetic oxide carrier core particles with zinc metal in an inert atmosphere, such as nitrogen or argon, wherein there results conductive carrier core particles. The heating can be accomplished at an effective temperature of for example, from about 350° to about 550° C. for an effective period of for example, from about 1 minute to about 24 hours, and preferably from about 5 minutes to about 2 hours. The temperature and duration selected can vary depending upon the scale at which the deposition coating process is conducted.

As indicated herein, the resultant metal modified conductive particles can be further modified by coating with at least one polymeric resin, and in embodiments, for example, from 2 to about 5 polymeric resins are selected. The polymeric coating can optionally contain conductive additive materials as indicated herein.

In embodiments, the present invention relates to a method for developing an electrostatic image comprising contacting the image with a two-component dry developer composition comprised of charged toner particles and oppositely charged carrier particles comprised of a core comprised of a magnetic oxide with a coating thereover comprised of the reaction product of zinc vapor and the magnetic oxide. Although not wanting to be limited by theory it is believed that the reaction product of the zinc vapor and the magnetic oxide on the surface of the core particles is a composite or slag of metallic iron or metallic zinc and the surface metal oxides. The magnetic oxide is a hard and or soft ferrite material and the coating thereover is comprised of from about 0.01 to about 5 percent by weight of zinc. The developer mixture comprises, for example, about 1 part of the toner particles and from about 10 and about 200 parts by weight of the carrier particles.

Toner compositions can be prepared by a number of known methods, such as admixing and heating resin particles obtained with the processes of the present invention such as water soluble or water insoluble styrene butadiene copolymers, pigment particles such as magnetite, carbon black, or mixtures thereof, and cyan, yellow, magenta, green, brown, red, or mixtures thereof, and preferably from about 0.5 percent to about 5 percent of charge enhancing additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter.

Illustrative examples of resins suitable for toner and developer compositions of the present invention include preferably thermoplastics, such as branched styrene acrylates, styrene methacrylates, styrene butadienes, vinyl resins, including branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene butadiene copolymers, mixtures thereof, and the like. Other preferred toner resins include styrene/n-butyl acrylate copolymers, PLIOLITES®; suspension polymerized styrene butadienes, reference U.S. Pat. No. 4,558,108, the disclosure of which is totally incorporated herein by reference.

In toner compositions, the resin particles are present in a sufficient but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL®, metal salts and metal salts of fatty acids inclusive of zinc stearate, metal oxides, like aluminum oxides, cerium oxides, and mixtures thereof, which additives are generally present in an amount of, for example, from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are optionally present in the toner composition or the polymer resin beads in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

Encompassed within the scope of the present invention are colored toner and developer compositions comprised of toner resin particles, carrier particles, the charge enhancing additives illustrated herein, and as pigments or colorants red, blue, green, brown, magenta, cyan and/or yellow particles, and mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts, including for example, in an amount of from about 2 percent by weight to about 15 percent by weight based on the weight of the resin particles.

For the formulation of developer compositions, there are mixed with the toner particles carrier components, particularly those that are capable of triboelectrically assuming an opposite polarity to that of the toner composition. Illustrative examples of carrier particles include magnetic oxides such as the magnetically hard strontium ferrite, barium ferrite, lead ferrite, cobalt ferrite, and mixtures thereof, and magnetically soft ferrites, such as, ferrous ferrite, manganese ferrite, nickel ferrite, copper ferrite, magnesium ferrite, and the like, and mixtures thereof, and mixtures thereof with nonmagnetic oxides such as zinc ferrite, and wherein the carrier particles are preferably obtained as illustrated herein, and more specifically by the reaction of the metal, such as zinc vapor with the ferrites.

The selected carrier particles can be used with or without a coating, the coating generally containing terpolymers of styrene, methylmethacrylate, and a silane, such as triethoxy silane, reference U.S. Pat. No. 3,526,533, U.S. Pat. No. 4,937,166, and U.S. Pat. No. 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 20 microns to about 300 microns, and in embodiments from about 60 to about 95, and more preferably about 75 microns. The carrier component can be mixed with the toner composition in various suitable combinations, however, preferred results are obtained when about 2 to 15 parts toner to about 100 part by weight of carrier are selected.

The toner composition of the present invention can be prepared by a number of known methods as indicated herein including extrusion melt blending the toner resin particles, pigment particles or colorants, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 5 to about 25 microns, and more preferably from about 8 to about 12 microns. Also, the toner compositions preferably possess a triboelectric charge of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Developers based on the present invention may be used with development subsystems known in the art, either conventional magnetic brush with soft magnetic oxide carrier cores or magnetic brush devices containing rotating inner multipole magnet assemblies with hard magnetic oxide carriers.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Conductivity Measurement of Carrier Core Particles

A modified pellet press was used for the measurement of carrier core resistivity, or equivalently its conductivity. The apparatus comprises a piston, a housing for the piston, a base to support the housing. An insulating sleeve was provided to contain the particle sample, and the press piston and base were electrically isolated from one another and connected across an ohmmeter. A carrier sample was introduced into the press and compressed into a cylinder of diameter D and height h under about 100 psi pressure. The cylinder dimensions and the resistance of the sample R were recorded, and the equivalent resistivity of the core material computed according to the formula:

$$\rho = \frac{\pi D^2 \cdot R}{4h} .$$

The resulting packed bed resistivity is higher than the bulk resistivity of the material of the carrier core because of the resistance of the contacts between carrier beads, and it probably better characterizes the electrical properties of the developer bed than would the bulk resistivity of the core material. Using this measurement method an untreated sample of magnetically soft nickel-zinc ferrite carrier core, that is used to prepare carrier for the Xerox Corporation Model 9200 duplicator, was found to have a bed resistivity in excess of $8\times10^7$ ohm-centimeters, a greater value being unmeasurable because of the limited range of the ohmeter. The same ferrite, after zinc treatment described in Example III, was found to have a bed resistivity of less than about 16 ohm-centimeters.

EXAMPLE II

Preparation of Zinc Treated Magnetically Hard Carrier Core Particles

Into a rotating ribbed 2 liter flask were placed 500 grams strontium ferrite carrier core (FDK-30 micron nominal diameter, available from FDK America Inc., San Jose, Calif.) and 25 grams zinc dust (325 mesh, available from Aldrich Chemical Co.). Under a positive pressure of argon the mixture was blended for 30 minutes, then heated to 400° C. for about 30 minutes, then at 500° C. for about 60 minutes, and finally cooled to room temperature, about 25 degrees Centigrade. The apparatus used for this Example was comprised of a modified rotoevaporator wherein the round bottom flask was contained within a modified, temperature regulated ceramic kiln. Scanning electron microscope examination of the resulting product indicated that essentially all of the zinc dust has been consumed by apparent reaction or deposition upon the surface of the carrier core particles. No post treatments or separations were necessary. In contrast, attempts to electroless plate nickel metal onto carrier particles from liquid solutions, in addition to failing to deposit any metals, resulted in the production of a sludge material which was difficult to handle and was nearly intractable.

The weight fraction of zinc metal dust was determined by repeated trials beginning with excess zinc dust and systematically reducing the level until no free residual zinc remained after the heating sequence. A temperature of 400° C. was selected primarily because at 400° C. zinc metal dust has a significant vapor pressure that is just below its melting point, so it is available to react as a vapor but cannot melt into a large, low surface area mass. The 500° C. heating interval was introduced into the procedure after it was observed to decrease the bed resistivity of the resulting zinc treated particles. The bed resistivity of the zinc treated carrier core particles was measured by the method of Example I to be about 700 ohm-centimeters. A sample, 10 grams, of the treated core particles was magnetized in a field of about 2,000 gauss and found to be permanently magnetized as indicated by its transformation from a freely flowing powder into a powder having a consistency similar to wet sand.

EXAMPLE III

Preparation of Zinc Treated Magnetically Soft Carrier Core Particles 100 grams of a magnetically soft nickel-zinc ferrite carrier core, that used to make carrier for the Xerox Model 9200 duplicator, with particles of 100 microns nominal diameter, together with 5 grams of zinc dust were treated by the process and apparatus of Example II. The bed resistivity of the resulting carrier core particles measured by the method of Example I was about 16 ohm-centimeters. A ferrite developer roll magnet was observed to form an excellent magnetic brush with the treated core material. Apparently no significant loss of magnetic properties resulted from the zinc vapor treatment. Although not wanting to be limited by theory, it is believed that the lower bed resistivity relative to treated FDK ferrite is attributable to the relatively greater porosity of the latter, which would tend to consume more zinc and to partially interrupt the conducting surfaces formed by the treatment. It is also believed that less porous cores would allow use of lower zinc weight fractions.

EXAMPLE IV

Electrical Stability Evaluation Of Zinc Treated Core Particles

Treatment with hot zinc vapor changes the bed resistivity of ferrite carrier core particles from more than about $10^8$ ohm-cm to less than about $10^3$ ohm-cm. Although not wanting to be limited by theory, it is believed that the zinc treatment probably increases the conductivity by increasing the number density of charge carrying electrons, thus oxidation might reverse the process in time. This is observed but only to a limited extent. Experimental results indicate that a carrier sample held at ambient temperature loses conductivity first, then stabilizes at a value which is, for practical xerography, electrically conductive. A portion of a zinc treated carrier, for example, as according to the process of Example II, was left at ambient laboratory conditions and periodically measured by the packed-bed resistance measurement described in Example I. Bed resistivity started at about 200 ohm-centimeters, increased to about 1,000 ohm-centimeters after 30 days, and remained at about 1,000 ohm-centimeters out to about 60 days. The result is consistent with a progressive oxidative attack on a conductive skin. Thus, over the test period, carrier retained at lab ambient conditions appeared to stabilize. Only holding a sample in moisture containing air at 200° C. could there be induced a loss of conductivity that continued beyond 60 days. Furthermore, the porosity of these carrier cores probably increases their susceptibility to attack and less porous cores may be expected to be even more stable.

EXAMPLE V

Magnetic Properties of Zinc Treated Carrier Particles

An untreated sample of FDK core and a sample treated according to the method of Example II were examined in a vibrating sample magnetometer (VSM) available from Princeton Applied Research, Princeton, N.J. It was observed that treatment had reduced remanence from about 2.5 kilogauss to about 1 kilogauss and saturation magnetization from about 32 emu per gram to about 23 emu per gram. Thus the treated core had sufficient magnetization to be regarded as usefully magnetized and its remanence was enough to preserve magnetization in all but very strong developer magnets. It appears that, if necessary, higher remanence could be exchanged for by specifying less porous cores, lower zinc weight fractions, higher core resistivity, or some combinations thereof.

EXAMPLE VI

Xerographic Performance of Zinc Treated Carrier Particles

Two xerographic developers A and B were prepared, identical in components and amounts except for the carrier used to make them. The carrier in Developer A was magnetized, uncoated, untreated FDK 30 micron ferrite and the carrier in Developer B was magnetized, uncoated, FDK 30 micron treated according to the method of Example II. The Example toner was a pigmented polyester wherein the polyester comprises a linear polyester of, for example, a bisphenol compound and a dicarboxylic acid which is crosslinked to 30 percent gel content with, for example, styrene, and let down with uncrosslinked resin to 5% gel content. The resin particles are sized to a nominal diameter of 7 microns, and treated with known surface additives, by weight about 1% hydrophobic silica and 0.3% zinc stearate. Both developers, mixed at a toner concentration of about 10%, had toner triboelectrification values of about −21 microcoulombs per gram, showing that zinc treatment did not disrupt toner charging. Methods of measuring tribo values in hard magnetic two component developers are known in the art; see for example Miskinis et al., U.S. Pat. No. 4,546,060, the disclosure of which is incorporated herein by reference in its entirety. The example development apparatus was similar to that disclosed by Alexandrovich et al, U.S. Pat. No. 5,409,791, the disclosure of which is incorporated herein by reference in its entirety. Initially the developer shell and the image member were spaced apart by about 700 microns and the AC voltage applied between them was about 2,000 volts peak to peak at 2 kilohertz. Image member speed was about 12 inches per second, development voltage about 400 volts, and background voltage about −130 volts. Electrostatic images were developed with both developers. Developer B was observed to produce multiple image spots ascribed to AC electrical breakdown from the developer bed to the image member, showing that developer B, based on zinc treated core, was effectively conductive at 2 kilohertz, which is fast enough to follow image detail moving through the development zone, while developer A, based on untreated core, was not. Subsequent reduction in AC voltage was observed to eliminate the image spots.

Other modifications of the present invention may occur to one of ordinary skill in the art based upon a review of the present application and these modifications, including equivalents thereof, are intended to be included within the scope of the present invention.

What is claimed is:

1. A carrier composition comprised of a core comprised of a magnetic oxide with a coating thereover comprised of zinc metal obtained by the reaction product of zinc vapor and said magnetic oxide, wherein the weight of zinc metal used to form the zinc vapor is from about 0.5 to about 10 weight percent relative to the weight of the core particles.

2. A carrier composition in accordance with claim 1, wherein the coating further comprises a layer of metallic zinc codeposited with said reaction product coating.

3. A carrier composition in accordance with claim 2, further comprising coating said carrier composition with at least one polymer.

4. A carrier composition in accordance with claim 3, wherein the polymer coated carrier further comprises a conductive additive contained in the polymer coating.

5. A carrier composition in accordance with claim 1, wherein said magnetic oxide is a hard magnetic ferrite material selected from the group consisting of strontium ferrite, barium ferrite, lead ferrite, cobalt ferrite, and mixtures thereof.

6. A carrier composition in accordance with claim 1, wherein said magnetic oxide is a soft magnetic ferrite material selected from the group consisting of ferrous ferrite, manganese ferrite, nickel ferrite, copper ferrite, magnesium, ferrite, zinc ferrite, and mixtures thereof.

7. A carrier composition in accordance with claim 1, wherein the thickness of said coating is from about 0.01 to about 10 microns.

8. A carrier composition in accordance with claim 1, wherein the coated carrier is electrically conductive with a packed bed resistivity of from about $10^{-1}$ to about $10^{5}$ ohm-centimeters.

9. A developer composition comprising a carrier composition of claim 1, and a toner formulation comprising a pigment and a resin.

10. A process for the preparation of electrically conductive magnetic oxide carrier particles comprising:

heating a mixture of magnetic oxide carrier core particles with zinc metal in an inert atmosphere, wherein there results conductive carrier core particles.

11. A process in accordance with claim 10, wherein the heating is accomplished at a temperature of from about 350° to about 550° C. for a period of time of from about 5 minutes to about 2 hours.

12. A process in accordance with claim 10, wherein the core particles are comprised of a hard magnetic ferrite material selected from the group consisting of strontium ferrite, barium ferrite, lead ferrite, cobalt ferrite, zinc ferrite, and mixtures thereof.

13. A process in accordance with claim 10, wherein the core particles are comprised of a soft magnetic ferrite material selected from the group consisting of ferrous ferrite, manganese ferrite, cobalt ferrite, nickel ferrite, copper ferrite, magnesium, ferrite, zinc ferrite, and mixtures thereof.

14. A process in accordance with claim 10, further comprising coating the resultant conductive particles with at least one polymeric resin.

15. A process in accordance with claim 14, wherein from 2 to about 5 polymeric resins are selected.

16. A process in accordance with claim 14, further comprising incorporating a conductive additive into the polymeric resin.

* * * * *